United States Patent [19]

Moore et al.

[11] Patent Number: 4,977,576

[45] Date of Patent: Dec. 11, 1990

[54] SAFETY FLOW STOPPER FOR WATER-COOLED ELECTRODE

[75] Inventors: Lyman T. Moore, Niagara Falls; Mark D. Travers, Sanborn, both of N.Y.

[73] Assignee: Great Lakes Carbon Corporation, New York, N.Y.

[21] Appl. No.: 336,615

[22] Filed: Apr. 10, 1989

Related U.S. Application Data

[63] Continuation of Ser. No. 249,275, Sep. 22, 1988, abandoned, which is a continuation of Ser. No. 778,581, Sep. 20, 1985, abandoned.

[51] Int. Cl.[5] ..... H05B 7/06

[52] U.S. Cl. ..... 373/93

[58] Field of Search ..... 373/91–94

[56] References Cited

U.S. PATENT DOCUMENTS

| | | | |
|---|---|---|---|
| 4,488,312 | 12/1984 | Montgomery et al. | 373/93 |
| 4,495,624 | 1/1985 | Reimpell et al. | 373/92 |
| 4,559,630 | 12/1985 | Maes | 373/93 |
| 4,603,424 | 7/1986 | Fuchs et al. | 373/93 |

*Primary Examiner*—Roy N. Envall, Jr.

*Attorney, Agent, or Firm*—Burns, Doane, Swecker & Mathis

[57] ABSTRACT

A safety flow stopper in a water-cooled electric arc furnace electrode comprises a bob 16 held in place above a valve seat 12 by a release pin 17 resting on the bottom of the cavity in the nipple 20. If the electrode fails the release pin will no longer support the bob which will seat in the valve seat, shutting off the coolant flow and averting an explosion in the furnace.

27 Claims, 7 Drawing Sheets

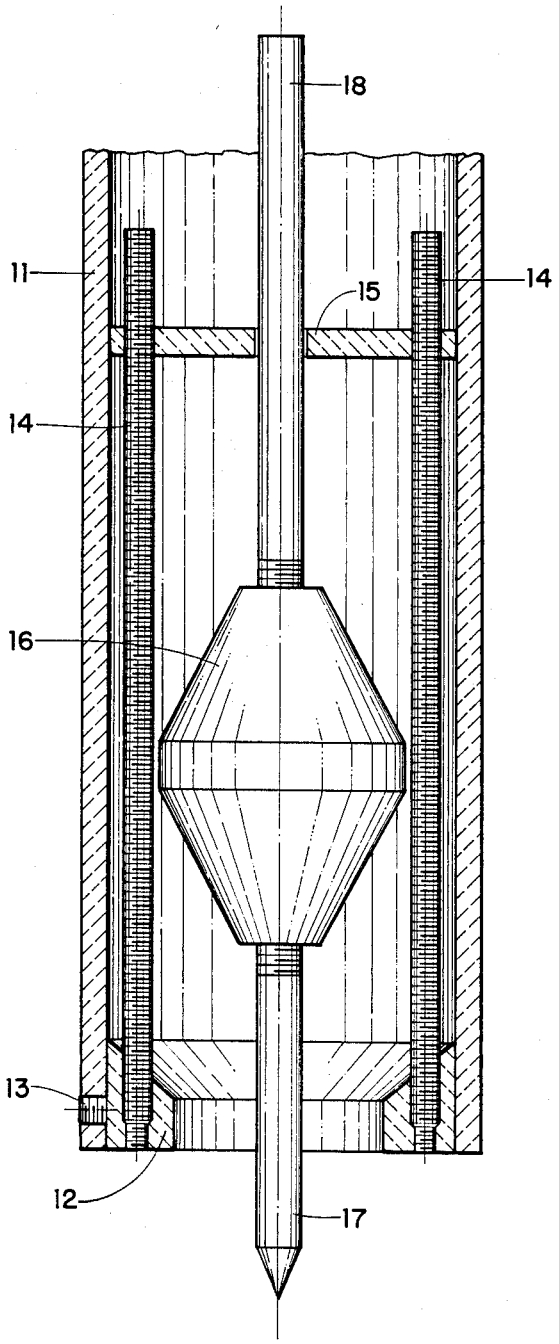
· Fig. 1 ·

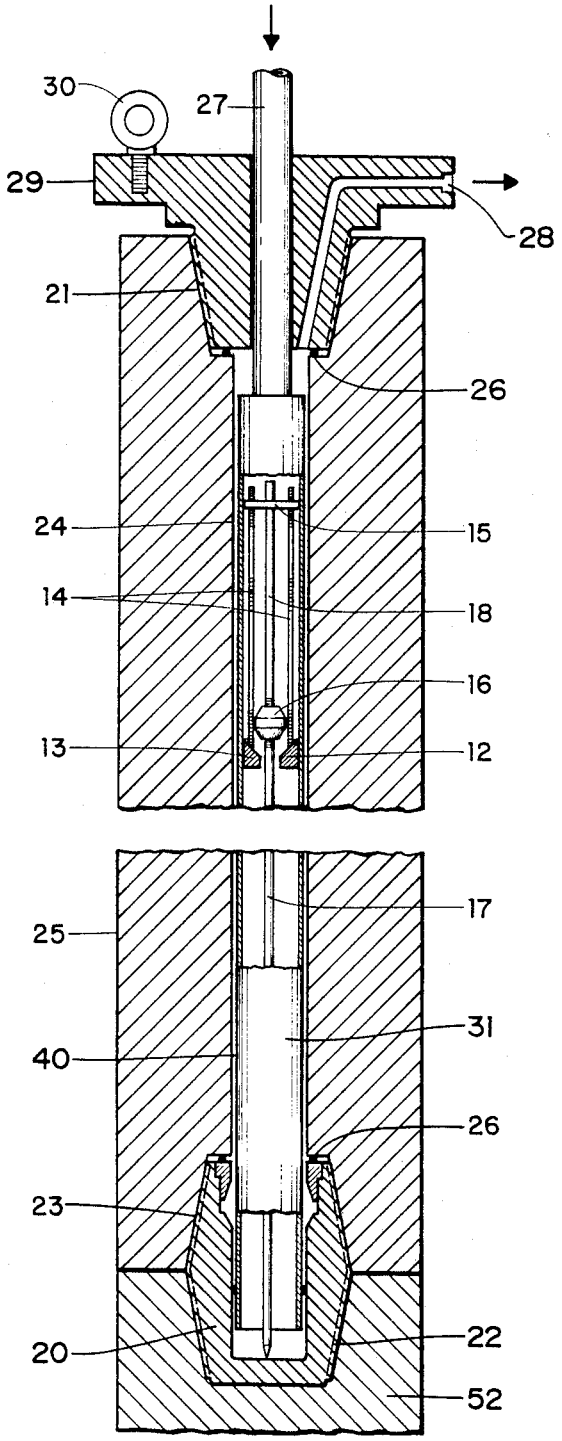
· Fig. 2 ·

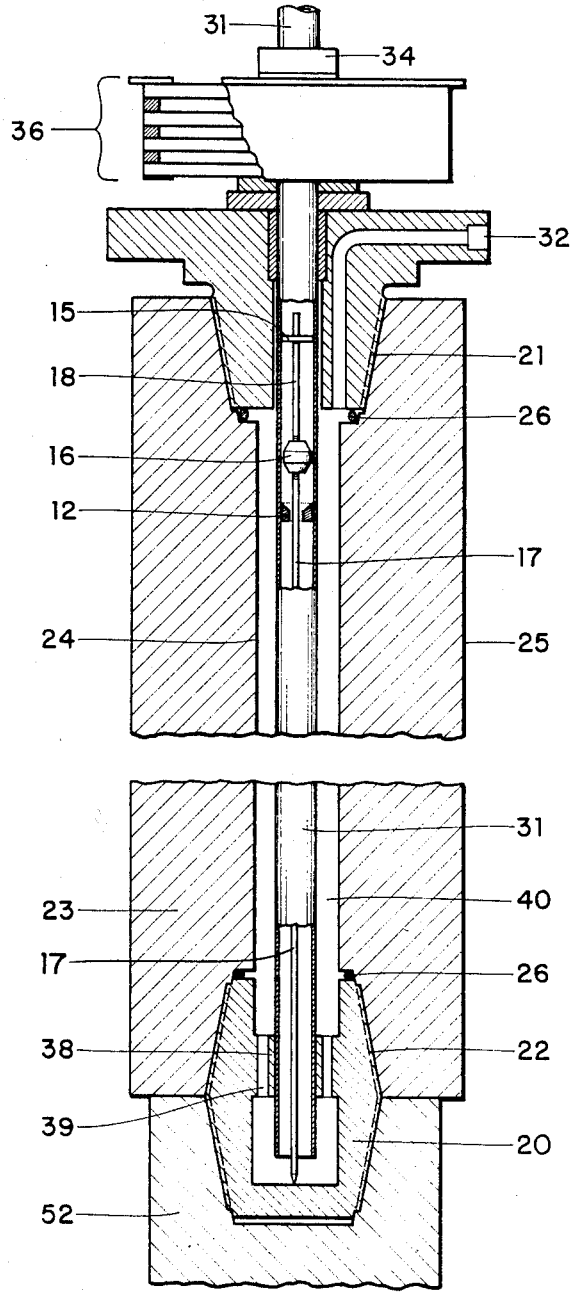
· Fig. 3 ·

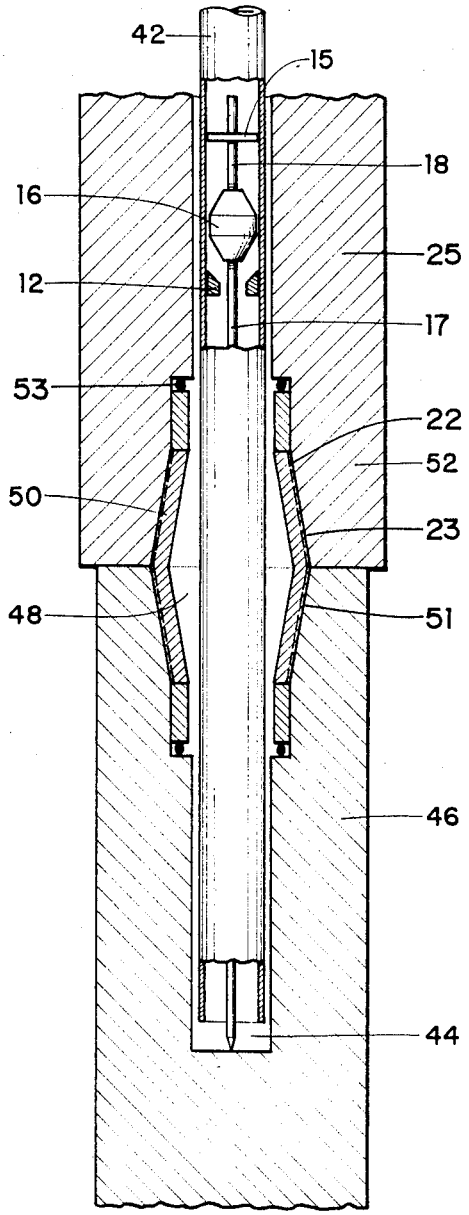
· Fig. 4 ·

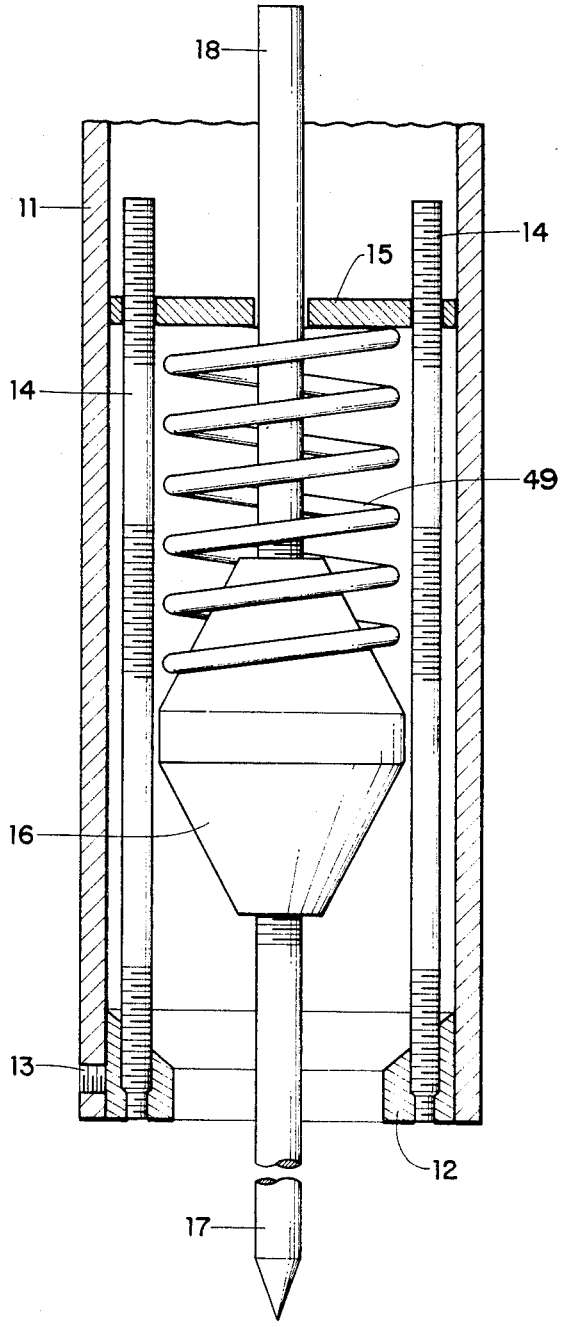
· Fig. 5 ·

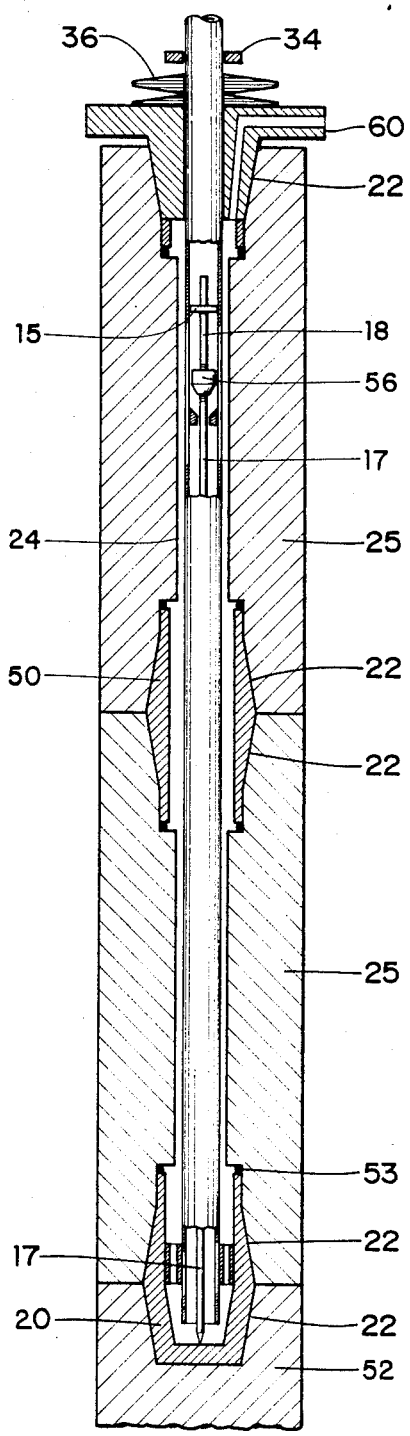
· Fig. 6 ·

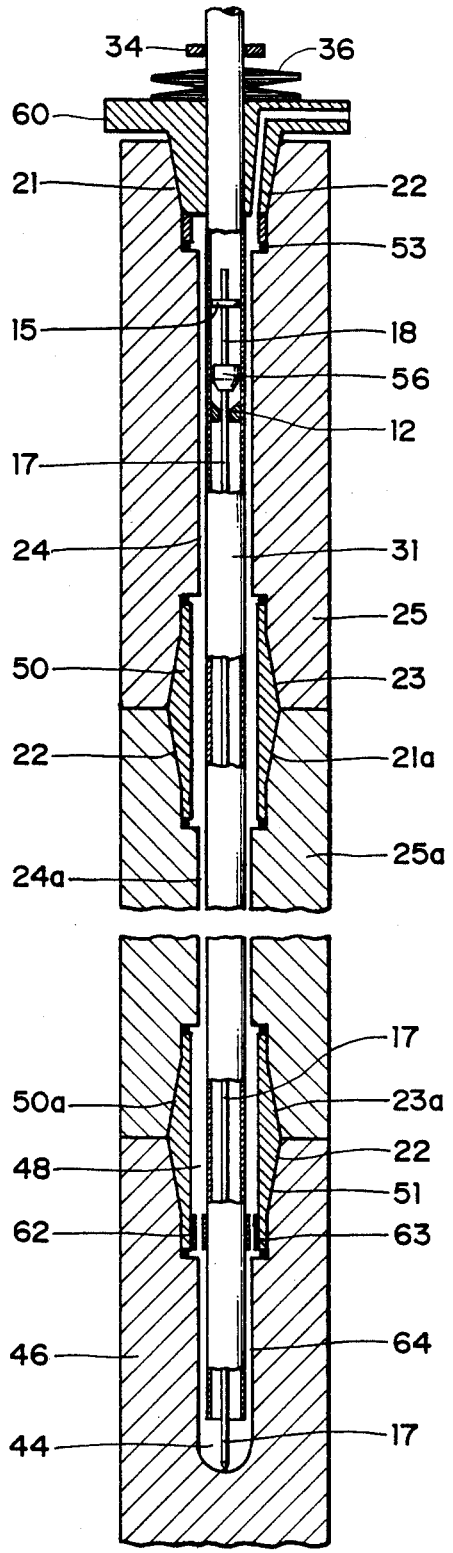
· Fig. 7 ·

SAFETY FLOW STOPPER FOR WATER-COOLED ELECTRODE

This application is a continuation of application Ser. No. 07/249,275, filed Sept. 22, 1988, in turn a continuation of Ser. No. 06/778,581, filed Sept. 20, 1985 both now abandoned.

RELATED APPLICATIONS

This application is related to U.S. Pat. No. 4,513,425 and U.S. Pat. No. 4,490,824 and Ser. No. 573,704, filed Jan. 25, 1984, which are incorporated by reference herein.

BACKGROUND OF THE INVENTION

1. Field of the Invention

The invention relates to a water-cooled electrode string for electric arc furnaces, and particularly to a composite electrode comprising one or more hollow graphite bodies with a central bore through which a tube carries cooling water exiting the tube into a hollow nipple or electrode and flowing back up through the central bore to an exit at the upper end of the composite electrode. In this invention, a consumable solid graphite electrode is normally at the lower end of the electrode string. If the composite electrode or nipple or the attached counterbored electrode of Ser. No. 573,704 fails in service resulting in a break or split, a large amount of cooling water could quickly flow into the furnace producing a large volume of steam resulting in an explosion. This invention is a safety shut-off acting as a first line of defense during such occurrences.

2. Previous Developments in the Art

The conventional material employed in electrodes for electric arc furnaces is graphite. These electrodes are consumed in use, for example in electric arc steel making furnaces, due to erosion caused by oxidation, sublimation, spalling and other factors. This consumption involves tip losses, column breakage losses and particularly surface oxidation losses. An average electric furnace consumes four to eight kilograms of graphite per metric ton of steel produced.

One method for reducing the consumption of graphite electrodes in arc furnaces has been the application of a protective coating or cladding material to the electrodes with oxidation resistant materials. These coatings generally increase the contact resistance to the electrode power clamp, and some are corrosive, as they are based on phosphoric acid. Consequently, they have not found wide acceptance.

Another means for reducing graphite electrode consumption involves the utilization of fully nonconsumable electrode systems. These systems employ full length liquid-cooled metal electrodes with selected apparatus to protect the electrode from the extreme temperatures of the arc. Although such systems are known, in practice they have not been successful due to high costs and known catastrophic failures in service.

It has been suggested that composite electrodes comprising carbon or graphite portions attached to a water-cooled metallic piece would provide a means for reducing electrode consumption in arc furnaces. A number of patents have issued on specific composite electrode designs. For example, U.S. Pat. Nos. 961,139 to Keller; 896,429 to Becket; 2,471,531 to McIntyre et al.; 3,588,307 to Kegel et al.; 3,392,227 to Ostberg; 4,121,042 and 4,168,392 to Prenn; 4,189,617 and 4,256,918 to Schwabe et al.; 4,287,381 to Montgomery; 4,291,190 to Elsner et al.; and U.S. Pat. No. 4,509,178 by Lades et al.

relate to liquid cooled composite electrodes for arc furnaces. Likewise, European Pat. application Nos. 50,682; 50,683; 53,200 by C. Conradty, Nurnberg; 115,812; and 77,513 and by Von Roll AG are directed to composite electrode configurations. These design versions are complex, expensive, and present numerous unsolved operational and manufacturing problems.

OBJECTS OF THE INVENTION

It is the objective of the invention to provide an improved composite electrode for electric arc furnaces with a fail-safe feature preventing catastrophic damage in the event of structural failure of the electrode body or attached components.

It is a further objective of the invention to provide a fail-safe feature for a composite electrode against furnace flooding, which is able to resist the harsh environment of an arc furnace and thereby have a long useful life.

SUMMARY OF THE INVENTION

The invention comprises a composite water-cooled electrode comprising a graphite heavy-walled tubular body having a central bore, a water inlet tube assembly with a flow stopper installed in the bore, a hollow truncated biconical metal nipple located at the furnace end of the tubular body for attachment of a conventional or bored graphite electrode, and a metal header at the upper end of the electrode.

The tubular graphite main structure body is made from a graphite arc furnace electrode with a threaded socket at each end. The central bore wall is preferably sealed to prevent water leakage and infiltration into or through the graphite wall. The exterior surface of the body may be treated with an anti-oxidant either by coating or impregnation. The electrode is drilled out with a center hole with a diameter not more than the minor diameter of the socket, leaving a heavy wall with a thickness preferably at least about ¼ of the outside diameter of the tube. The metal nipple is truncated, biconical, and hollow. A coolant tube having an outside diameter (OD) smaller than the inside diameter (ID) of the tubular electrode body leads into the electrode cavity from a coolant supply into the nipple or a bore in the tip electrode through the center of the tubular body. The coolant then returns upward to the outlet at the header through the annulus between the 0.D. of the coolant inlet tube and the I.D. of the bore of the main tubular body. The header is attached to the top of the graphite tube by the socket threads in the upper end of the main tube.

The coolant inlet tube assembly may also be used as a tensioning member as the means whereby compressive force is applied to the graphite body. The tube assembly is attached to the nipple and the header and held in tension by a tensioning device at the header. A spring, e.g., a Belleville washer is preferred; but other tensioning devices such as coil springs, air or hydraulic cylinders may also be used, and the invention is not limited to any one means of applying tension.

The electrode string may have one water-cooled unit with a graphite consumable electrode below it, or it may also have one or more intermediate water-cooled units joined with nipples having a tubular bore. Another version has a consumable electrode at the end having a counterbore for the coolant supply pipe.

The inner bore of the graphite tube is coated with a sealant to eliminate leakage and infiltration of water through the graphite. A silicone coating is preferred but other waterresistant surface coatings such as phenolic, alkyd, epoxy, polyurethane, polyester or acrylic resins may also be used.

This electrode is highly resistant to the heat and agressive atmosphere of the electric arc furnace and the top portion of the attached consumable electrode in the furnace stays dark in use indicating efficient cooling to a temperature lower than the oxidation temperature, with consequent lessening of oxidation and lower graphite consumption per unit of metal produced, than when using the normal all-graphite solid electrodes.

The coolant is normally water, however in special applications glycols or other thermal transmission fluids may be used.

The invention described herein is a flow stopper which comes into automatic operation in the event of breakage of an electrode components as described in e.g. U.S. Pat. Nos. 4,513,425, 4,490,824 or Ser. No. 573,704. In an electric arc furnace, the most common failure mode is breakage at the joint area, either in the socket or the nipple. In large electrodes of 500 mm (20 inch) and larger diameter, about 70% of failures are socket breaks, with progressively more nipple failures in smaller sizes. The 400 mm (16 and 18 inch) diameter electrodes have about equal fractions of nipple and socket failures, while smaller sizes have mostly nipple breaks. When using a metal, e.g. copper, nipple, it is expected that almost all breaks will be in the body or socket. In a typical application using a 400 mm water-cooled electrode and having a normal flow of about 200 l./min., the release of such an amount of water into the furnace will cause an instantaneous generation of steam and probably result in an explosion which may severely damage the furnace and endanger life. The flow stopper described is an automatic shut-off valve in the graphite tube located high in the bore above the most likely area of any breakage.

DESCRIPTION OF THE DRAWINGS

FIG. 1 is a drawing of the preferred embodiment in vertical section of the flow stopper as installed in the water inlet tube 11. Valve seat 12 is held in place by set screws 13 or other fastener. Threaded rods 14 extend from the valve seat 12 to upper stem guide 15. The flow stopper itself consists of bob 16, release pin 17 holding the bob is the raised position and upper guide pin 18 holding bob 16 in concentric alignment with water inlet tube 11.

FIG. 2 is an overall view of the flow stopper in position in the water-cooled electrode disclosed in U.S. Pat. No. 4,490,824 showing nipple 20 with threads 22 in lower socket 23 of graphite electrode 25 having center bore 24, coated for water impermeability, sealed with O-rings 26. The upper socket 21 is fitted with header assembly 29 having lifting ring 30, water inlet 27 connecting coolant inlet tube 31 and water outlet 28. If the lower socket 23 breaks, which is a possible failure mode, the nipple 20 will fall into the furnace, releasing the water in the annulus 40 between tube 31 and the center bore 24, but bob 16 will be released, shutting off the flow from inlet 27 instantaneously. Tip electrode 52 is conventional graphite or used body.

FIG. 3 is a view of the flow stopper installed in the electrode disclosed in U.S. Pat. No. 4,513,425. Bob 16 is installed in the central coolant inlet tube 31 with upper stem guide 15, release pin 17, upper guide pin 18, and valve seat 12. Coolant inlet tube 31 applies an upward force on nipple 20 holding the body 25 in compression through spider attachment point 38 and is maintained in tension by nut 34 applied to Belleville washers 36. Water flows in through inlet tube 31 to nipple 20 and returns through holes 39 in the nipple and annulus 40 to outlet 32. Tip electrode 52 is conventional graphite or used main tubular body.

FIG. 4 is a view of the invention as installed in an electrode disclosed in Ser. No. 573,704, filed Jan. 25, 1984. Water enters the inlet tube 42 to counterbore 44 in lower electrode 46 and returns through annulus 48 to an upper header as shown in FIG. 2 or 3. Nipple 50 is hollow and tubular, joining electrode body 25 and lower counterbored electrode 46, is threaded into sockets 23 and 51, and is sealed with O-rings 53. There may be more than one electrode bodies 25 joined by nipples 50 in a multi-stage version of the basic electrode.

FIG. 5 shows a flow stopper operated by spring means, 49 which may be installed in any position, forcing the bob 16 into contact with valve seat 12 when pin 17 is released.

Normally, the water pressure will be sufficient to actuate the flow stopper to close, with or without any other applied force. Thus this flow stopper may operate in any position, vertical, horizontal, or inverted from the drawings shown.

FIG. 6 is a view of the flow stopper installed in another multi-stage cooling electrode disclosed in U.S. Pat. No. 4,813,425. Bob 56 is held in place by release pin 17, passing through tubular nipple 50 and resting on the bottom of the bore in nipple 20. Upper guide pin 18 holds the bob 56 concentric through upper stem guide 15. A lower conventional tip electrode 52 is suspended from nipple 20. There may be as many bodies 25 and nipples 50 as are necessary for any length furnace electrode string.

FIG. 7 is a view of the flow stopper installed in another multi-stage electrode. Inlet tube 31 holds electrode bodies 25 and **25*a* in compression between nut 34 and Belleville washers 36 on header assembly 60 attached to electrode body 25 by threads in socket 21, through attachment spider 62 having passages 63 on lower tubular nipple 50*a*. Bob 56 is held above valve seat 12 by release pin 17 resting on the bottom of counterbore 44 in bottom electrode 46. Bob 56 is held in axial alignment with inlet tube 31 by upper pin 18 in upper pin guide 15. The electrode is sealed with O-rings 53 on nipples 50 and 50*a* and 26 on header 60. The bores 24, 24*a*, and 64 of the electrode components are sealed with a sealant as disclosed above. Sockets 21 and 21*a*, 23 and 23*a* and 51 are all threaded to receive the threads on the header 60 and nipples 50 and 50*a*. Water enters the electrode at inlet 31 to counterbore 44 and returns through annuli 64 and 48, between the electrode bodies and tube 63 in spider 62, nipples 50*a* and 50 to outlet 32**.

The flow stopper of the invention is a shut-off valve in the central water or coolant inlet tube actuated mechanically by spring action, by gravity, and/or water pressure. In a vertical installation, the preferred embodiment, a body with a lower surface designed to seal against a valve seat in the inlet tube is maintained in an open raised position by a lower stem extension resting on the bottom of a hollow nipple shown in U.S. Pat. No. 4,490,824 or 4,513,425. If used in a flow-through multi-stage design shown in Ser. No. 573,704, the stem extension rests on the bottom of the counterbore. If the body of the electrode or the nipple fails, the stem will no longer be supported, and either a combination of water pressure and gravity, or spring action will close the valve, instantaneously shutting off the coolant flow.

The nipple, water inlet tube, and header assembly may be made of any suitable material such as steel, gray iron, ductile iron, aluminum, copper or stainless steel. Stainless steel is preferred for the header and water inlet tubes for its corrosion resistance while copper is preferred for the nipple. If the unit fails catastrophically in service, the addition of a gray iron or ductile iron nipple to a steel heat will not adversely affect the melt analysis, as will occur if the nipple is made of copper, Invar or aluminum.

The main body is preferably a graphite having a CTE of less than $15\times10^{-7}$ over the range of 0° to 50° C; otherwise, it may fail from thermal shock.

The CTE of an electrode varies between the longitudinal and transverse directions due to the crystal orientation of the graphite introduced during extrusion. The CTE figure used here is in the transverse direction normal to the long axis of the cylinder.

Although the flow stopper described here is described as a valve, it may not completely cut the coolant flow to zero. This is not absolutely essential as on failure of the electrode, the current will also be shut off and the electrode replaced. A trickle or relatively small flow of coolant will not be of such magnitude as to cause a danger to the installation.

The nipple is preferably of copper with a sliver plating for conductivity.

The examples given and the claims put forth here are not intended as limiting the invention to the specific disclosures herein, but also to any equivalent constructions, which are too numerous to mention.

This flow stopper may be used in a great variety of equipment to shut off the coolant flow in the event of structural failure, where either the loss of coolant or the reactions associated with such a loss pose a possibility of harm to people or property, and is thus not limited to water-cooled electrodes.

We claim:

1. A composite water-cooled electrode assembly for an electric arc furnace comprising a hollow body having a central cavity and a water inlet tube within said cavity, the improvement a water flow stopper comprising a valve seat in said tube, a valve body shaped to obstruct or seal against said valve seat, and a release pin resting on the bottom of said cavity holding said valve body spaced apart from the valve seat and the valve open during normal operation, said stopper actuated by failure of said assembly, releasing said pin and allowing said valve body to move against said valve seat and shut off the flow of cooling water.

2. In a composite water-cooled electrode for an electric arc furnace comprising a graphite tubular body having a central bore, a water inlet tube having a diameter smaller than the diameter of said bore, a hollow nipple at the lower or furnace end, and a header at the upper end, the improvement comprising a water flow stopper comprising a valve seat in said tube and a valve body surface shaped to obstruct or seal against said valve seat, a lower 7 release pin resting on said nipple bottom holding said valve body spaced apart from said valve seat in normal operation, said stopper actuated by failure of said body or said nipple allowing said release pin to move and allowing said valve body to move against said valve seat, stopping the water flow.

3. The electrode of claim 1 comprising a graphite tubular body, a header assembly at the upper end of said body apart from the furnace, a tubular nipple, and a graphite body having a counterbore, the release pin traversing said nipple and resting on the bottom of said counterbore, said release pin actuated by the failure of said tubular nipple or said counterbored graphite body to release said pin and allow the valve body to move against the valve seat and shut off the coolant flow.

4. The electrode of claim 1 comprising a header assembly, a first tubular graphite body, a first hollow tubular nipple, a second tubular graphite body, a second hollow tubular nipple, a third counterbored lower graphite electrode, the release pin resting on the bottom of the counterbore in said third counterbored electrode during normal operation, and actuated by failure of said first, second or third electrode or said first or second tubular nipple, releasing said pin and allowing the valve body to move against the valve seat and shut off the coolant flow.

5. The electrode of claim 1 comprising a header assembly having a coolant inlet tube and coolant outlet, a first tubular graphite body, a first hollow tubular nipple, a second tubular graphite body, a second hollow nipple closed at its lower or furnace end, a solid graphite electrode attached to said second nipple, a water inlet tube traversing said first body, said first nipple, and said second body and terminating in said second nipple, the improvement comprising a safety flow stopper in said inlet tube having a valve seat attached to the inner wall of said tube, a stopper with a surface matching said valve seat, and a release pin resting on the bottom of said second nipple holding said stopper spaced apart from said valve seat in normal operation and actuated by failure of any of said first or second graphite bodies or said first or second nipples, releasing said pin and allowing said stopper to seat against said valve seat and shut off the coolant flow.

6. The electrode of claim 1 wherein the flow stopper comprises a valve bob with a conical lower surface.

7. The electrode of claim 1 comprising a plurality of threaded rods projecting upwardly from the valve seat, and a stem guide threadedly mounted on the threaded rods such that the valve seat, rods and stem guides are movable as a unit into position within the water inlet tube, and means for attaching the unit in place within the inlet tube, the flow stopper bob having an upper guide stem traversing the stem guide whereby the valve is maintained in concentric axial alignment with the water inlet tube.

8. The electrode of claim 1 wherein the electrode body is treated with an anti-oxidant.

9. The electrode of claim 1 wherein the electrode body is graphite having a coefficient of thermal expansion of no more than $15\times10^{-7}$ over the range of 0° C. to 50° C. in the direction normal to the major axis of the cylinder.

10. The electrode of claim 1 comprising a copper nipple with silver plating.

11. The electrode of claim 10 wherein the nipple is in the shape of a double truncated cone with the largest diameter at the center of the nipple.

12. The electrode of claim 1 wherein the flow stopper is a gravity and/or pressure and/or spring means operated valve actuated by either loss or breakage of the nipple, or body of said electrode.

13. The electrode of claim 1 installed in a horizontal position.

14. The electrode of claim 1 installed in an inverted position from normal, with the functional end uppermost.

15. The electrode of claim 1 wherein the inlet tube is utilized to create a compressive force on the electrode by tension between the header and the nipple prestressing the graphite body.

16. In an electric arc furnace having a hollow water-cooled electrode comprising a heavy-walled graphite tubular body and having a hollow nipple open at its upper end with a central water inlet tube therein, the improvement comprising a flow stopper in said water inlet tube whereby the water supply is immediately shut off in the event of structural failure of said tubular electrode body or nipple.

17. The furnace of claim 16 having a heavy-walled graphite tubular electrode with a hollow metal nipple at its lower end holding a counterbored graphite electrode, the flow stopper actuated by failure of the body, nipple, or the counterbored electrode.

18. The furnace of claim 16 in which the flow stopper is a weighted bob with an upper guide extension and a lower release stem resting on the bottom of the nipple, with a conical lower surface shaped to obstruct a valve seat on the interior of the water inlet tube.

19. A water-cooled composite electrode for an electric arc furnace comprising a metal header with water inlet and outlet, one or more heavy-walled graphite tubular bodies having a coated central bore and threaded truncated sockets at each end, a central water inlet tube having a smaller diameter than said central bore attached to said header, a hollow truncated conical nipple at the end opposite said header holding a graphite electrode having a bore, the water inlet tube leading into said bore, the inside diameter of said nipple being larger than the outside diameter of said inlet tube, the improvement comprising a flow stopper in said water inlet tube operated by gravity and/or pressure comprising a bob having an upper guide pin traversing an upper guide and a lower release pin resting on the bottom of said bore and having a valve seat shaped to seal the lower surface of said bob against said valve seat in said water inlet tube, said flow stopper actuated by the structural failure of said nipple or body of the electrode to stop the flow of cooling water through the electrode.

20. A cylindrical clamp member of a composite electrode, which clamp member can be fixed to the electrode crosshead of an electric arc furnace and which includes a flow path for a coolant and which at a lower end carries a screwthreaded portion for screwing on a replaceable lower portion of the composite electrode, which lower portion is liable to being burnt away, characterized in that disposed in the flow path is a shut-off means which is biased in the closure direction, having an actuating member by which the shut-off means can be put into the open condition against the biasing force when the lower portion is screwed onto the screwthreaded portion.

21. A clamp member as set forth in claim 20 characterized in that the actuating member, in the closed condition of the shut-off means, projects from the screwthreaded portion in a region which is occupied by a region of the lower portion when the lower portion is screwed on.

22. A clamp member as set forth in claim 21, characterized in that the shut-off means includes an axially displaceable rod as the actuating member, which rod at one end carries a shut-off member which is disposed in the flow path, and at the other end projects out of the end of the screwthreaded portion.

23. A clamp member as set forth in claim 22, characterized in that the actuating member is guided within a sleeve provided with duct means for the coolant.

24. A clamp member as set forth in claim 20, characterized in that in a lower portion thereof, in the flow path for the coolant, it has a flange through which passes at least one duct, and the duct can be closed off by the shut-off means.

25. A clamp member as set forth in claim 20, characterized in that the shut-off means is biased by a spring.

26. A clamp member as set forth in claim 20, characterized in that the shut-off means is biased by the pressure of the coolant.

27. A clamp member as set forth in claim 20, characterized in that the screwthreaded portion includes a duct for the coolant, which is disposed in the flow path for said coolant.

* * * * *